US005303437A

United States Patent [19]

Hung

[11] Patent Number: 5,303,437

[45] Date of Patent: Apr. 19, 1994

[54] MULTI-FUNCTION AND AUTOMATIC SICK BED

[76] Inventor: Yung-Feng Hung, 3 Fl.-2, No. 28, Pei Pin E. Rd., Taipei, Taiwan

[21] Appl. No.: 991,356

[22] Filed: Dec. 16, 1992

[51] Int. Cl.[5] ..... A61G 7/06

[52] U.S. Cl. ..... 5/613; 5/607; 5/611; 5/617

[58] Field of Search ..... 5/607, 611, 613, 616, 5/617, 619

[56] References Cited

U.S. PATENT DOCUMENTS

| | | | |
|---|---|---|---|
| 2,500,792 | 3/1950 | Taylor | 5/618 |
| 3,300,793 | 1/1967 | Thompson | 5/613 X |
| 3,593,350 | 7/1971 | Knight | 5/616 |
| 4,084,274 | 4/1978 | Willis et al. | 5/613 X |
| 4,225,988 | 10/1980 | Cary et al. | 5/607 |
| 4,658,450 | 4/1987 | Thompson | 5/616 X |
| 5,125,122 | 6/1992 | Chen | 5/607 X |

*Primary Examiner*—Michael F. Trettel
*Attorney, Agent, or Firm*—W. Wayne Liauh

[57] ABSTRACT

A multi-function and automatic sick bed, which comprises left and right elevating mechanisms, front and rear elevating mechanisms, each of the aforesaid elevating mechanisms includes motor, gears, screw rod and connecting rod; each such elevating mechanism can be adjusted to provide a comfortable position for a patient's head, legs or feet.

1 Claim, 6 Drawing Sheets

MULTI-FUNCTION AND AUTOMATIC SICK BED

BACKGROUND OF THE INVENTION

Most of the conventional sick beds have their manual type of multi-function adjustment features respectively; however, the aforesaid adjustment features each have drawbacks in real operation, and therefore, they are going to be replaced with an automatic sick bed.

In a conventional automatic sick bed, the head, and legs of a patient, and the height of the bed can all be adjusted to a given angle or height desired by the patient. The adjusting mechanism thereof is usually a hydraulic type or a mechanical type.

In fact, the manufacturing cost of a hydraulic type of adjusting mechanism is relatively high, and therefore it is not used widely; instead, the mechanical type of adjusting mechanism has widely been used; however, the aforesaid adjusting mechanism can only provide an elevating adjustment for a sick bed, and three or four folding elevating adjustments for a patient's head, legs and feet; in other words, non of them can be adjusted at a given angle according to a patient's requirements; such adjustment features are deemed unable to meet the requirements of some patients, such as replacing a bed sheet for a patient.

SUMMARY OF THE INVENTION

This invention relates to a multi-function and automatic sick bed, and particularly to a mechanically controlled sick bed. The sick bed comprises elevating mechanism, the left and right elevating mechanisms, and the front and rear elevating mechanisms for patient's head, legs and feet. The aforesaid elevating mechanisms each are operated with a motor to drive gears, screw rods, and connecting rods, whereby the frames on the sick bed can be lifted up so as to meet a patient's requirements to place his (or her) head, legs and feet on a comfortable position; further, the front and rear elevating mechanisms can have the sick bed divided into eight foldable pieces so as to provide a patient with a comfortable lying position, and a quick replaceable bed sheet.

DETAILED DESCRIPTION

Figure 1:
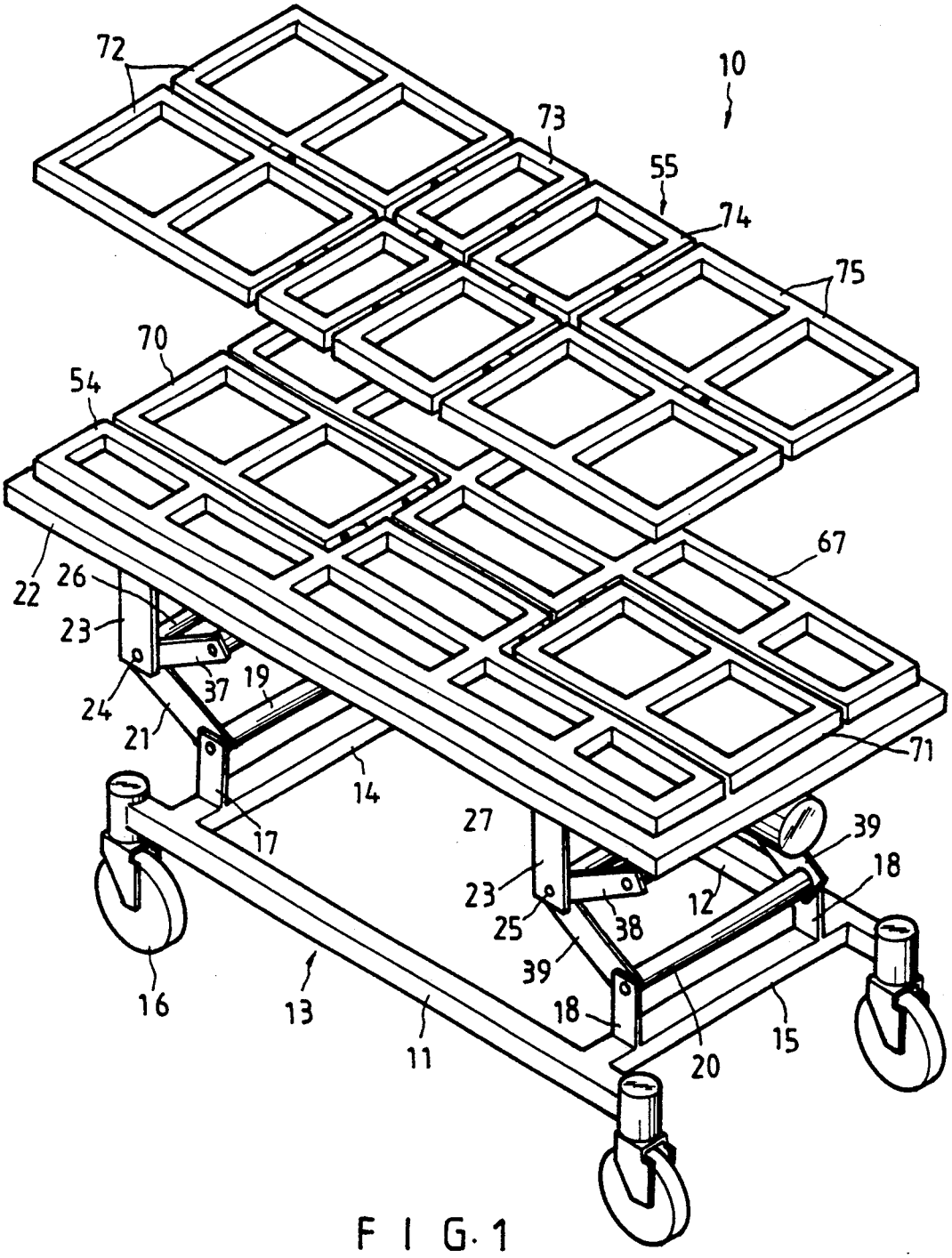
FIG. 1 is a disassembled view of an embodiment according to the present invention.
Figure 2:
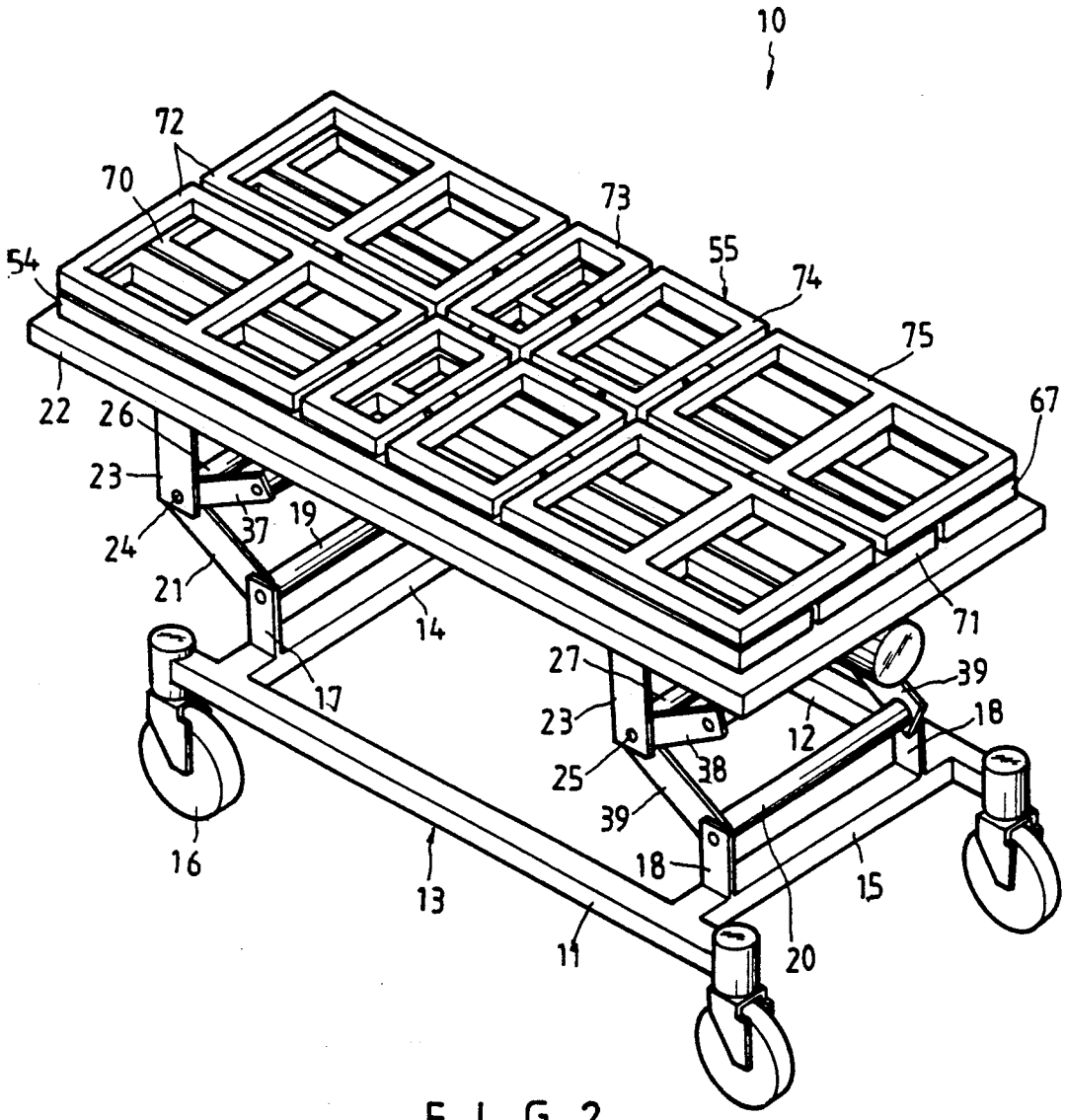
FIG. 2 is a perspective view of the present invention.
Figure 3:
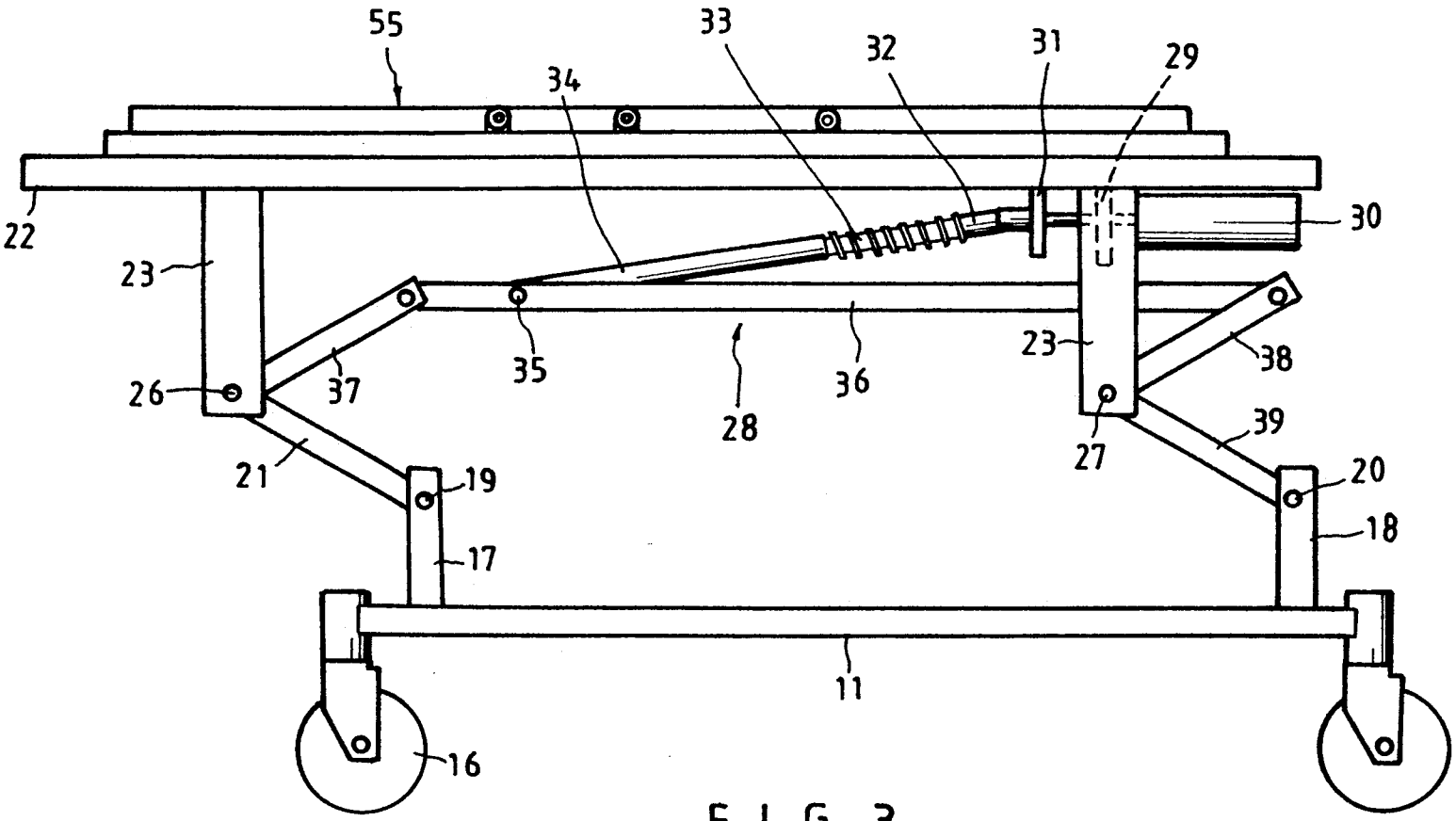
FIG. 3 is a side view of a bed elevating mechanism of the present invention.

Referring to FIGS. 1 and 2, the disassembled view and the perspective view of the present invention show the structure thereof without being covered with the outer cover and decorations. The sick bed 10 according to the present invention comprises a base frame 13 having two longitudinal rods 11 and 12, which are connected together with two horizontal rods 14 and 15. The four corners of base frame 13 are mounted with four castors 16 respectively to provide the base frame 13 with a mobile function. The top side of both ends of the horizontal rod 14 is furnished with two vertical supports 17; the top side of both ends of the horizontal rod 15 is also furnished with two vertical supports 18. The two vertical supports 17 (of which one support is not shown) are connected together with a horizontal shaft 19, which the vertical supports 18 are connected with a horizontal shaft 20. Each of the vertical supports 17 is connected with a short support 23 under one end of the bed frame 22 through a connecting rod 21, while each of the vertical supports 18 is connected with short support 23 under the other end of the bed frame 22 through a connecting rod 39 (in FIG. 1, only two short supports 23 on the right side are shown). Two short supports 23 on both sides of the bed frame 22 are connected together with a horizontal shaft 26, which is mounted between two pivot joints 24. The two short supports 23 under the rear end of the bed frame 22 are connected together with a horizontal shaft 27, which is mounted between two pivot joints 25. The bed frame 22 is substantially a rigid rectangular flat frame, which is mounted over the base frame 13 by using four short supports 23 and two connecting rods 21 and 39. Referring to FIG. 3, the bed frame 22 has a bed elevating mechanism 28 mounted under the rear end thereof. Under the bed frame 22, a bearing plate 29 with a motor 30 is mounted. The spindle of the motor 30 is mounted through another bearing plate 31; one end of the motor shaft is mounted with a universal joint 32, which is then connected with a screw rod 33; the screw rod 33 is fitted in a sleeve 34. When the motor 30 is rotating, the sleeve 34 will, through the universal joint 32 and the screw rod 34, be driven to move back and forth; one end of the sleeve 34 is connected with a longitudinal rod 36 through a pivot 35. The front end of the longitudinal rod 36 is connected with a short support 23 and a connecting rod 21 through a connecting rod 37 and a pivot joint 26. The rear end of the longitudinal rod 36 is connected with a short support 23 and a connecting rod 39 through a connecting rod 38 and a pivot joint 27. When the sleeve 34 drives the longitudinal rod 36 to move forwards or backwards, the connecting rods 37 and 38 will pull the connecting rods 21 and 39 to turn clockwise or counter-clockwise around the horizontal shafts 19 and 20 as fulcrums respectively. When the connecting rods 21 and 39 turn clockwise, the short supports 23 will move upwards to cause the bed frame 22 and the top layer frame 55 to move upwards; otherwise, the short supports 23 will move downwards to cause the bed frame 22 and the top layer frame 55 to move downwards; in other words, the bed elevating mechanism 28 is to be operated with the motor 30 to actuate the universal joint 32, the screw rod 33, the sleeve 34, the longitudinal rod 36 and the connecting rods 37 and 38 so as to have the bed frame 22 moved upward or downward.

Figure 4:
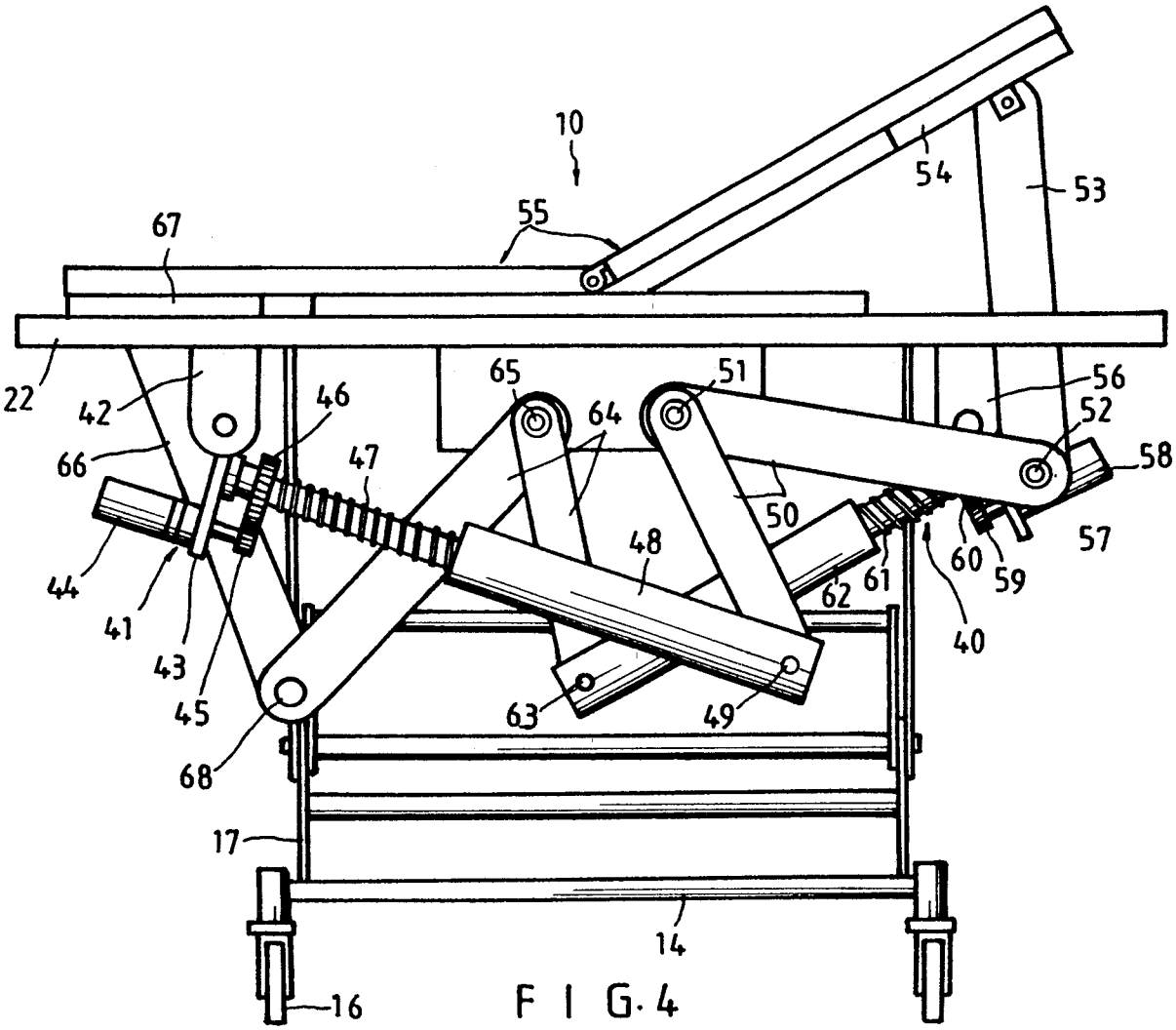
FIG. 4 is a front view of the left and right elevating mechanism of the present invention.

FIG. 4 illustrates a left and a right elevating mechanism 40 and 41 being mounted on the front end of a sick bed. The right elevating mechanism 41 is mounted on the left side of the sick bed, and it includes a U-shaped base 42 pivotally fitted with a bearing plate 43, which is mounted with a motor 44; the spindle of the motor 44 is mounted with a small gear 45 engaged with a large gear 46 that is mounted on the bearing plate 43. The spindle of the large gear 46 is connected with a screw rod 47 which is movably engaged in a sleeve 48; the right end of the sleeve 48 is connected with a <-shaped connecting rod 50 through a pivot 49. The <-shaped connecting rod 50 includes two sections, of which the bent point is mounted under the bed frame 22 with a pivot 51; the pivot 51 is also used as a fulcrum of the two sections; one end of the connecting rod 50 is connected with a connecting rod 53 through a pivot 52. The upper end of the connecting rod 53 is connected with the right bed frame 54 on the bed frame 22. The right bed frame 54 is similar to a projected-up member (as shown in FIG. 2). The inner end of the frame 54 is connected with the mid surface of the bed frame 22 through a hinge, while the outer end thereof can be lifted up with the inner end as a fulcrum. When the motor 44 is rotated, the screw rod 47 will be driven, via the small and large gears 45 and 46, to rotate; then, the sleeve 48 will be driven to move; when the sleeve 48 is pushed forwards, the <-shaped connecting rod 50 will turn counter-clockwise around the pivot 51, and then the <-shaped connecting rod 50 will push the connecting rod 53 upwards; at the same time, the right bed frame 54 and the top layer frame 55 will be lifted upward; in other words, the right side of the sick bed 10 can be lifted upward. When the motor 44 is driven to rotate in opposite direction, the right side of the sick bed 10 will be lowered.

The left elevating mechanism 40 is mounted under the right front end of the sick bed 10, i.e., being opposite to the right elevating mechanism 41, and it has the same structure as that of the right elevating mechanism 41, and it includes a U-shaped base 56 mounted with a bearing plate 57. The lower part of the bearing plate 57 is fixedly attached with a motor 58, of which the spindle is fixedly attached with small gear 59 being engaged with a large gear 60 on the upper part of the bearing plate 57. The spindle of the large gear 60 is fixedly connected with a screw rod 61, which is movably engaged in a sleeve 62. The left end of the sleeve 62 is pivotally connected with a <-shaped connecting rod 64 through a pivot 63. The bent point of the <-shaped connecting rod 64 is pivotally attached to a pivot 65 under the bed frame 22. One end of the rod 64 is connected with a connecting rod 66 through a pivot 68; the upper end of the connecting rod 66 is connected with a left bed frame 67 on the bed frame 22; the left bed frame 67 is also similar to a projected-up member. The inner end of the left bed frame 67 is connected with the mid surface of the bed frame 22 through a hinge, while the outer end thereof can be lifted up with the inner end thereof as a fulcrum. The left bed frame 67 is mounted on the bed frame 22 in opposite position to that of the right bed frame 54. When the motor 58 is running, the screw rod 61 will be driven, through the small gear 59 and the large gear 60, to rotate to cause the sleeve 62 to move back and forth; when the sleeve 62 is extended, the <-shaped connecting rod 64 will be driven to rotate clockwise, and to move upwards to push the connecting rod 66 upwards through the pivot 65; then, one end of the left bed frame 67 and the left side of the top layer frame 55 will be lifted up; therefore, the left side of the sick bed 10 can be lifted up by starting the motor 58 to rotate in one direction, or can be lowered by having the motor 58 to rotate in opposite direction.

Figure 5:
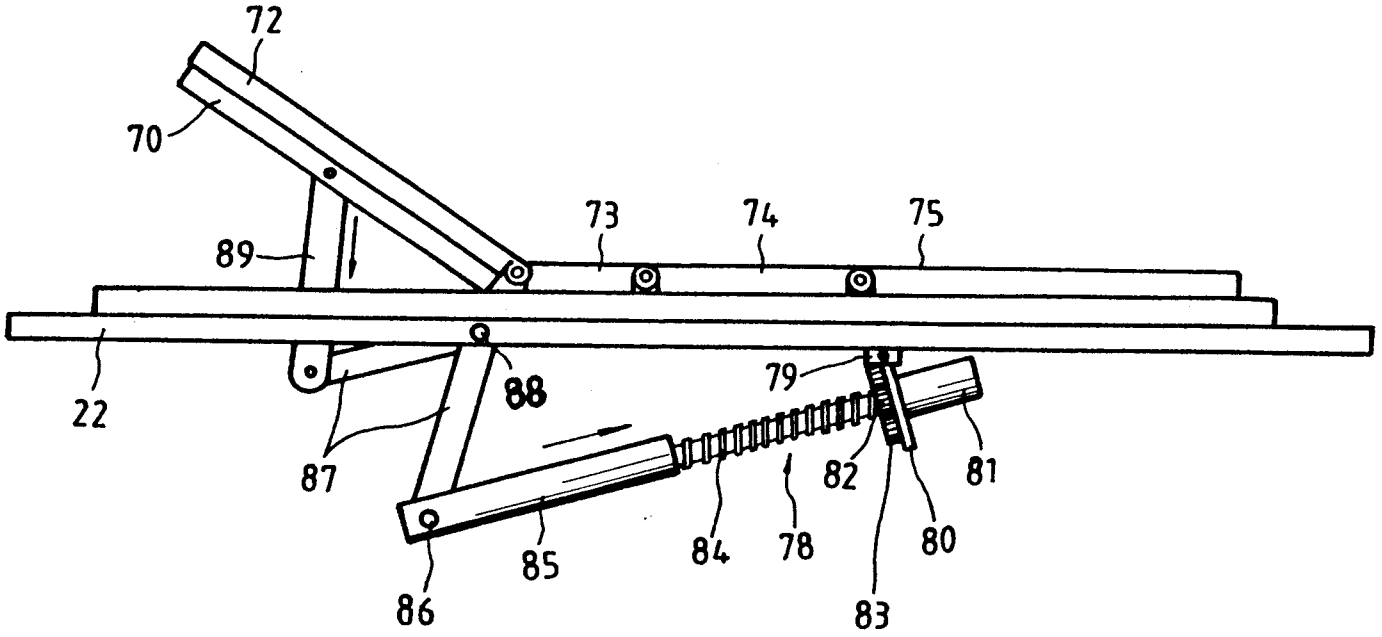
FIG. 5 is a side view of a front elevating mechanism of the present invention.

As shown in FIG. 1, the top layer frame 55 is a rectangular member to be mounted above the front and rear bed frames 70 and 71, the left and right bed frames 67 and 54, and the bed frame 22; the top layer frame 55 is a symmetrical 8 foldable frames. The top layer frame 55 includes two foldable front frames 72, two mid-front frames 73, two mid-rear frames 74 and two rear frames 75, which are assembled together with hinges. A front bed frame 70 and a rear bed frame 71 are fitted between the left bed frame 67 and the right bed frame 54. Both the front and rear bed frames 70 and 71 are in a rectangular shape respectively. The rear side of the front bed frame 70 is attached to the top surface of the bed frame 22 with hinges; the front side of frame 70 can be lifted up by using the rear side thereof as a fulcrum (as shown in FIG. 5). A front elevating mechanism 78 is mounted under the rear end of the bed frame 22; the mechanism 78 includes a U-shaped base 79 mounted with a bearing plate 80, which is mounted with a motor 81; the spindle of the motor 81 is mounted with a small gear 82 engaged with a large gear 83, of which the spindle is connected with a screw rod 84; the rod 84 is movably engaged in a sleeve 85. The rear end of the sleeve 85 is pivotally connected with a <-shaped connecting rod 87 through a pivot 86. The bent point of the rod 87 is pivotally mounted under the bed frame 22 through a pivot 88 which is used as a fulcrum. One end of the connecting rod 87 is pivotally connected with a connecting rod 89, which is pivotally connected under the front bed frame 70. When the motor 81 is running, the small gear 82 will drive the large gear 83 and the screw rod 84 to rotate, and to cause the sleeve 85 to move back and forth. When the sleeve 85 extends out, the <-shaped connecting rod 87 will be turned counter-clockwise around a pivot 88 to push a screw rod 89 upwards, and then the front bed frame 70 will be turned upwards around the rear end as a fulcrum so as to lift the front frame 72 of the top layer frame 55 to provide the front part of a sick bed with a function of moving up or down.

Figure 6:
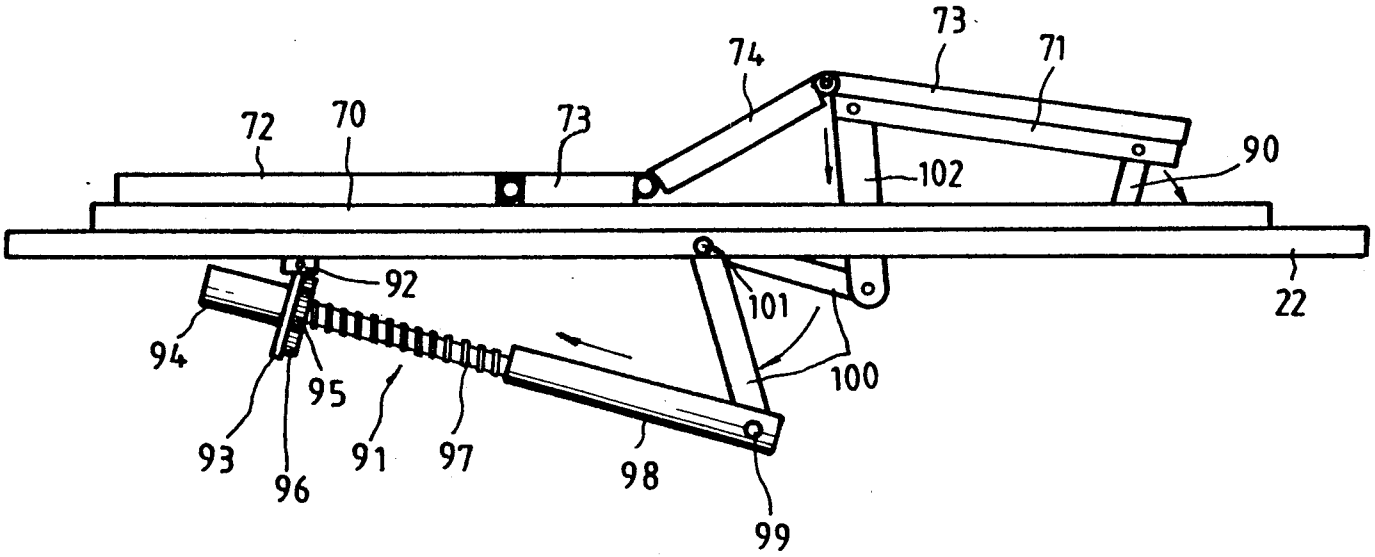
FIG. 6 is a side view of a rear elevating mechanism of the present invention.

As shown in FIG. 6, the rear end of the rear end frame 71 is fixed, with a connecting rod 90, to the top surface of the bed frame 22; the front end of the rear end frame 71 can be lifted up by using the connecting rod 90 as a fulcrum. A rear elevating mechanism 91 is mounted under the front end of the bed frame 22. The rear elevating mechanism 91 includes a U-shaped base 92 mounted with a bearing plate 93; a motor 94 is mounted under the bearing plate 93. The spindle of the motor 94 is fastened with a small gear 95, which is engaged with a large gear 96; the spindle of the large gear 96 is connected with a screw rod 97, which is movably engaged in a sleeve 98; the rear end of the sleeve 98 is pivotally connected with a <-shaped connecting rod 100 through a pivot 99. The bent point of the rod 100 is pivotally connected with the bottom of the bed frame 22 through a pivot 101 used as a fulcrum. One end of the rod 100 is connected with another connecting rod 102 which is connected with the front bottom surface of the rear bed frame 71. When the motor 94 is running, the screw rod 97 will be driven, through the small and large gears 95 and 96, to rotate to cause the sleeve 98 to move back and forth; when the sleeve 98 extends out, the <-shaped connecting rod 100 will turn counter-clockwise around the pivot 101 to push the connecting rod 102 upwards; then, the rear bed frame 71 will be lifted up with the rear end thereof as a fulcrum, and simultaneously the rear frame 75 of the top layer frame 55 will be lifted up or lowered to an extent desired.

Since the top layer frame 55 includes a plurality of foldable pieces, it not only can adjust the lifting angle of the left and right sides of a sick bed by using the left and right elevating mechanisms 40 and 41, but also can adjust the top layer frame 55 in eight different folding angles by using the front and rear elevating mechanisms 78 and 91 respectively so as to meet a patient's requirements for his (or her) head or leg, or foot, etc. to be rested at various positions. Further, the left-and-right side adjustment of the sick bed can facilitate the replacement of a bed sheet.

I claim:

1. A multi-function and automatic sick bed which allows a patient to place his (or her) head, arms, legs, and feet at a most comfortable position comprising:

(a) a base frame comprising two longitudinal rods and two horizontal rods connected together to form a substantially rectangular frame having four corners, and four castors mounted under the four corners, respectively, of said base frame to provide said base frame with a mobil function;

(b) a bottom layer bed frame being mounted above said base frame by means of a plurality of first vertical supports, second vertical supports, and first connecting rods; said bottom layer bed frame being a rectangular rigid flat frame having a top portion, a middle portion and a bottom portion said first vertical supports being affixed to said base frame, said second vertical supports being affixed to said bottom layer bed frame, and said first vertical and second vertical supports being movably connected by said first connecting rods;

(c) a middle layer bed frame above said bottom layer bed frame comprising a left bed frame, a right bed frame, a rear bed frame and a front bed frame, wherein (i) said left bed frame and said right bed frame being two opposite and symmetrical members; said left bed frame having an inner side and an outer side, the inner side of said left bed frame being pivotally connected to the middle portion of said bottom layer bed frame to allow the outer side of said left bed frame to pivot upward, said right bed frame having an inner side and an outer side, the inner side of said right bed frame being pivotally connected to the middle portion of said bed bottom layer bed frame to allow the outer side of said right bed frame to pivot upward, (ii) each of said rear bed frame and said front bed frame having an inner and an outer side, the inner side of each said front bed frame and said rear bed frame being also hinged to the middle portion of said bottom layer bed frame so as to allow the outer side of each of said front and rear bed frames to be lifted upward;

(d) a top layer bed frame disposed vertically above said left and right bed frames and said front and rear bed frames, said top layer bed frame comprising two front frames, two mid-front frames, two mid-rear frames, and two rear frames, each pair of said two front frames, said two mid-front frames, said two mid-rear frames and said two rear frames are hinged together to allow pivotal movement therebetween, said two front frames and said two mid-front frames, and said two mid-rear frames and said two rear frames are also respectively hinged together to allow pivotal movement with respect thereto;

(e) a bed elevating mechanism mounted under said bottom layer bed frame comprising a first motor, a first screw rod, a pair of second connecting rods, a longitudinal rod and a first sleeve, said longitudinal rod is connected to said two second vertical supports through said pair of second connecting rods respectively, and said sleeve being adapted to cause a horizontal movement of said longitudinal rod, whereby when said first motor is actuated, said first screw rod and said first sleeve will cause a horizontal movement of said longitudinal rod so as to cause vertical movements of said second vertical supports, thus allowing said bottom layer, middle layer and top layer bed frames to be lifted upward or downward;

(f) a left elevating mechanism and a right elevating mechanism for tilting left side and right side, respectively, of said top layer and middle layer bed frames, said left and right elevating mechanisms being mounted under said bottom layer bed frame, and each of said left and right elevating mechanisms comprising a second motor, a second gear assembly, a second screw rod, a second sleeve and third and fourth connecting rods, said fourth connecting rod being affixed to said left or right frame, said second motor being connected to said left or right frame via said second screw rod, said second sleeve, and said third and fourth connecting rods in such a manner that when said second motor is actuated, said fourth connecting rods will be lifted upward or downward to cause said left or right bed frame to pivot about the inner side thereof; and (g) a front elevating mechanism and a rear elevating mechanism for tilting front end and rear end, respectively, of said top layer and middle layer bed frames, said front and rear elevating mechanism being mounted under said bottom layer bed frame, and each of said front and rear elevating mechanisms comprising a third moter, a third gear assembly, a third screw rod, a third sleeve, and fifth and sixth connecting rods, said sixth connecting rod being affixed to said front or rear frame, and said third motor being connected to said top or rear frame of said middle layer bed frame via said third screw rod, said third sleeve, and said fifth and sixth connecting rods in such a manner that when said third motor is actuated, said sixth connecting will be lifted upward or downward to cause said front or rear bed frame to pivot about the inner side thereof.

* * * * *